US007971966B2

(12) United States Patent
Shimazu et al.

(10) Patent No.: US 7,971,966 B2
(45) Date of Patent: Jul. 5, 2011

(54) INK JET RECORDING HEAD

(75) Inventors: Satoshi Shimazu, Kawasaki (JP); Yuki Kozuka, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 770 days.

(21) Appl. No.: 11/956,755

(22) Filed: Dec. 14, 2007

(65) Prior Publication Data

US 2008/0143787 A1 Jun. 19, 2008

(30) Foreign Application Priority Data

Dec. 15, 2006 (JP) ..... 2006-338199
Oct. 31, 2007 (JP) ..... 2007-283519

(51) Int. Cl.
*B41J 2/14* (2006.01)
*B41J 2/16* (2006.01)

(52) U.S. Cl. ..... 347/50; 347/58

(58) Field of Classification Search ..... 347/50, 347/56–59

See application file for complete search history.

(56) References Cited

U.S. PATENT DOCUMENTS 6,060,770 A * 5/2000 Nakamura et al. ..... 257/668
6,084,612 A * 7/2000 Suzuki et al. ..... 347/50
6,530,641 B2 3/2003 Ohashi et al.
2007/0006459 A1 1/2007 Ono et al.
2009/0094833 A1 4/2009 Kanda et al.

FOREIGN PATENT DOCUMENTS

JP 10-044442 2/1998

* cited by examiner

*Primary Examiner* — Juanita D Stephens
(74) *Attorney, Agent, or Firm* — Fitzpatrick, Cella, Harper & Scinto

(57) ABSTRACT

An ink jet recording head includes a recording element substrate having an energy generating member for generating energy in accordance with an electric signal, and an electrode portion for receiving the electric signal to be supplied to the energy generating member; an electric line member including an opening in which the recording element substrate is contained, an electric line extending toward an inside of the opening and connected to the electrode portion, an inclined electric wiring extending in a direction crossing with the electric line and contacted to the recording element substrate. The electric line member is disposed above a surface, having the electrode, of the recording element substrate, wherein the inclined member extends in a direction of an arrangement of a plurality of such electric lines, and constitutes an inclined surface descending from the electric wiring toward the surface of the recording element substrate.

7 Claims, 9 Drawing Sheets

INK JET RECORDING HEAD

FIELD OF THE INVENTION AND RELATED ART

The present invention relates to an ink jet recording head which records by causing ink droplets to jet out of its ink jetting openings (holes).

An ink jet recording apparatus such as an ink jet printer has an ink jet recording head (which hereafter will be referred to as recording head) provided with an energy generating means which generates the energy used for jetting ink from ink jetting openings (holes). The essential structural components of this type of recording head are a recording head chip and an electrical wiring tape. The recording head chip has the ink jetting openings (holes), energy generating means, liquid chamber(s) (to which ink is delivered), etc. The electrical wiring tape is a flexible member through which the recording head chip is supplied with electrical signals from an external source.

First, a typical method for manufacturing a recording head such as the above described one will be briefly described. First, the energy generating means (heat generating resistors, for example) and the electrically conductive wiring for supplying the heat generating resistors with electricity, are formed on a substrate for forming the recording head chip. Then, the energy generating means and wiring are covered with a protective film. Next, the portion of the recording head chip, which has the ink passages and ink jetting openings (holes), is formed. Then, the substrate on which multiple recording head chips have been formed through the above described steps is diced to separate the array of recording head chips into individual recording head chips. Then, the pads of each recording head chip are plated, or provided with a ball bump, in order to make it possible for the recording head chip to be connected to an electrical. wiring tape. Then, the completed recording head chip is connected to an electrical wiring tape. More concretely, the electrical contacts (which hereafter may be referred to as pads) of the recording head chip are connected to the leads of the electrical wiring tape. Then, sealant is applied to the area having the joints between the pads of the recording head chip and the leads of the electrical wiring tape to cover (seal) the joints, and is hardened to electrically insulate the joints, and also, to reinforce the joints.

Referring to FIG. 7A, in the case of a recording head chip, in accordance with the prior art, which is manufactured through the above described steps, it has been a common practice to connect the pads of the recording head chip 1 with the leads of the electrical wiring tape 10, at both edges of the recording head chip, which are perpendicular to the rows of ink jetting openings (holes) of the recording head chip. Next, referring to FIG. 7B, the joints between the pads 2 of the recording head chip 1, and the leads 12 of the electrical wiring tape 10, are covered with a first sealant 30, whereas the areas other than these electrical joints are generally sealed with a second sealant 31 (Japanese Laid-open Patent Application H10-44442). The second sealant 31 is for preventing the problem that ink reaches the back surface of the recording head chip 1 by circumventing the first sealant 30.

Incidentally, the size and shape of the opening 11 of the electrical wiring tape 10 is determined so that a distance (D1) between one of the long edges of the recording head chip 1, and the corresponding edge of the opening 11 is greater than a distance (D2) between one of the short edges of the recording head chip 1 and the corresponding edge of the opening 11 (FIG. 7A). This set up is for making it easier to apply the first sealant 30. Incidentally, if the distance (D1) is equal to or less than the distance (D2), the distance (D1) will be too small for the needle of a sealant dispenser to enter the gap between the abovementioned long edge of the recording head chip 1 and corresponding edge of the opening 11 when applying the sealant 31. If the needle cannot be placed in the gap (D1), it may be impossible to satisfactorily apply the sealant 31, and also, the needle of the dispenser may crack the recording head chip 1 by colliding with the edge(s) of the recording head chip 1 when applying the sealant 31.

As described above, in the case of a recording head in accordance with the prior art, a substantial amount of gap is provided between the recording head chip 1 and electrical wiring tape 10. Therefore, the second sealant 31, that is, the first sealant to be applied, cannot satisfactorily support the first sealant 30, that is, the second sealant to be applied. Thus, when the first sealant 30 is applied, it sinks (invades) into the sealant 31, failing thereby to be properly applied, as shown in FIG. 7B. Therefore, some leads 12 remain exposed. If any of the leads 12 remains exposed, it may come into contact with ink, being thereby corroded by the ink.

Further, even when the first sealant 30 can be precisely applied, there is the following problem to be dealt with, That is, if the first and second sealants 30 and 31 are hardened at the same time, both of the lengthwise end portions of the body of first sealant 30 are pulled downward (thickness direction of recording head chip 1) by the contraction of the body of second sealant 31 (by which body of first sealant 30 is surrounded), which occurs as the sealant 31 hardens. Therefore, the lengthwise end portions of the body of first sealant 30 sometimes crack. The presence of cracks in the first body of sealant 30 allows ink to seep into the body of first sealant 30, allowing thereby the ink to come into contact with some of the leads 12 and corrode them. Thus, a preset manufacturing sequence had to be followed to prevent this problem. That is, it had to be after the hardening of the body of second sealant 31 that the first sealant 30 was applied and hardened. This requirement added to the number of steps carried out to manufacture a recording head chip 1, which was problematic in that this requirement in turn made it necessary to prepare a large number of various manufacturing apparatuses.

One of the solutions to the above described problem is to change the shape of the opening 11 of the electrical wiring tape 10, as shown in FIGS. 8A and 8B, so that the distance between the portion of the recording head chip 1, which has the pads 12 (electrical contacts), and the edge of the opening 11 which are parallel to the rows of ink jetting openings 3 (holes), is smaller than the distance between the rest of the recording head chip 1 and the edge of the opening 11, which are parallel to the rows of ink jetting openings 3 (holes). Reducing the distance between the portion of the head chip 1, which has the pads 12 and the corresponding edge of the opening 11, which are parallel to the rows of ink jetting openings 3 (holes), positions a part of the electrical wiring tape 10 between the body of first sealant 30 and body of second sealant 31, minimizing thereby the above described effect, which the contraction of the body of second sealant 31 has upon the body of first sealant 30. Thus, even if the two bodies of sealants 30 and 31 are hardened at the same time, the problems, such as the cracking of the body of first sealant 30, do not occur. This solution, however, creates another problem. That is, in the past, in order to prevent the problem that the ink jetting openings (holes) 3 are damaged by the contact between the front surface of the substrate of the recording head chip 1 and recording medium, an ink jet recording cartridge was designed so that the surface of the electrical wiring tape 10, which faced the recording medium, was positioned higher than the surface of the recording head chip 1, which faced the recording medium, Here, "being positioned higher" means "being positioned farther from the surface of the sheet of paper which is in terms of the direction perpendicular to the surface of the sheet of paper (upward direction from surface of recording head chip 1)". Therefore, there was a step between the surface of the recording head chip 1, and the surface of the electrical wiring tape which was positioned higher than the surface of the recording head chip 1. This step was problematic in that it narrowed the portion of the body of first sealant 30, which corresponded in position to the step, as shown in FIG. 9. This narrowing of the body of first sealant 30 was more likely to occur while the needle for applying the first sealant 30 was moving across the step from the higher surface (surface of electrical wiring tape 10 to the lower surface (surface of recording head chip 1) than otherwise. The narrowing of the body of sealant 30 sometimes left some of the leads 12 exposed, allowing therefore ink to corrode the lead 12, which the body of sealant 30 failed to cover.

One of the methods for preventing the occurrence of this narrowing of the body of sealant 30 is to increase the amount by which the first sealant 30 is applied. However, increasing the amount of the first sealant 30 increases in thickness the resultant body of sealant 30, making it possible for the body of sealant 30 to touch the recording medium, Thus, in order to prevent the body of sealant 30 from touching the recording medium, the distance between the recording head and recording medium must be increased. Increasing the distance between the recording head and recording medium increases the distance between the ink jetting openings 3 (holes) and recording medium, which in turn reduces in an ink jet recording apparatus the accuracy with which each ink droplet hits its target point on the recording medium.

Another method for preventing the above described narrowing of the body of sealant 30 is to reduce the sealant 30 in viscosity. However, reducing the sealant 30 in viscosity makes it easier to run (flow), increasing in size the area which the sealant 30 covers (seals), which in turn makes it possible for the sealant 30 to spread wide enough to flow into some ink jetting openings 3 (holes). Further, the lower in viscosity the sealant 30, the thinner the resultant body of sealant 30. Thus, reducing the sealant 30 in viscosity may result in the failure, to satisfactorily seal the aforementioned electrical joints, making it thereby possible for ink to come into contact with some leads 12 and corrode them.

SUMMARY OF THE INVENTION

Thus, the primary object of the present invention is to provide a method for precisely applying sealant to proper portions of an ink jet recording head without derogatorily affecting the properties of the ink jet recording, in order to make it possible to provide a properly sealed ink jet recording head.

According to an aspect of the present invention, there is provided an ink jet recording head comprising a recording element substrate having energy generating means for generating energy in accordance with an electric signal, and an electrode portion for receiving the electric signal to be supplied to said energy generating means; an electric line member including an opening in which said recording element substrate is contained, an electric line extending toward an inside of the opening and connected to said electrode portion, an inclined electric wiring extending in a direction crossing with said electric line and contacted to said recording element substrate, wherein said electric line member is disposed above a surface, having the electrode, of said recording element substrate, wherein the inclined member extends in a direction of an arrangement of a plurality of such electric lines, and constitutes an inclined surface descending from said electric wiring toward the surface of said recording element substrate.

These and other objects, features, and advantages of the present invention will become more apparent upon consideration of the following description of the preferred embodiments of the present invention, taken in conjunction with the accompanying drawings.

DETAILED DESCRIPTION OF THE PREFERRED EMBODIMENTS

Embodiment 1

Figure 1A:
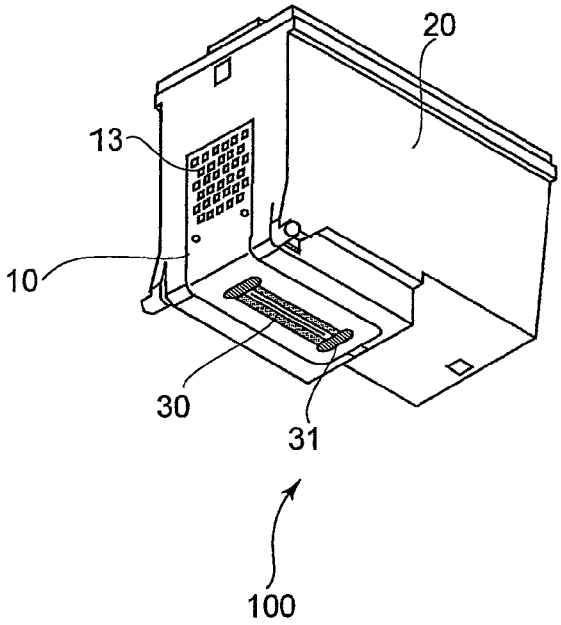
FIGS. 1A and 1B are perspective views of the ink jet recording cartridge in one of the preferred embodiments of the present invention.
Figure 1B:
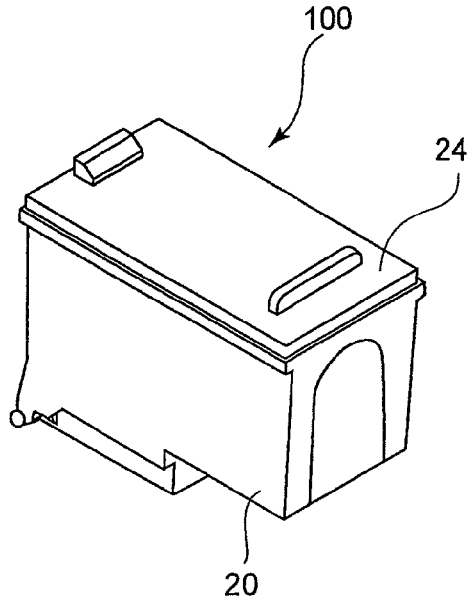
Figure 2A:
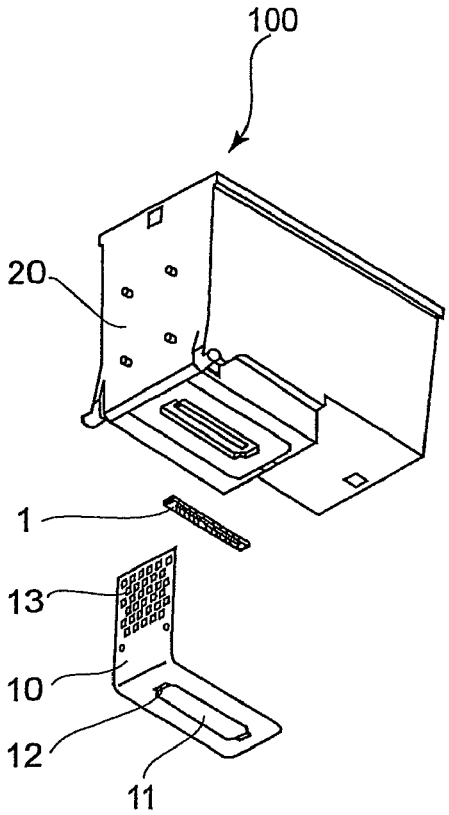
FIGS. 2A and 2B are exploded perspective views of the ink jet recording cartridge shown in FIG. 1.
Figure 2B:
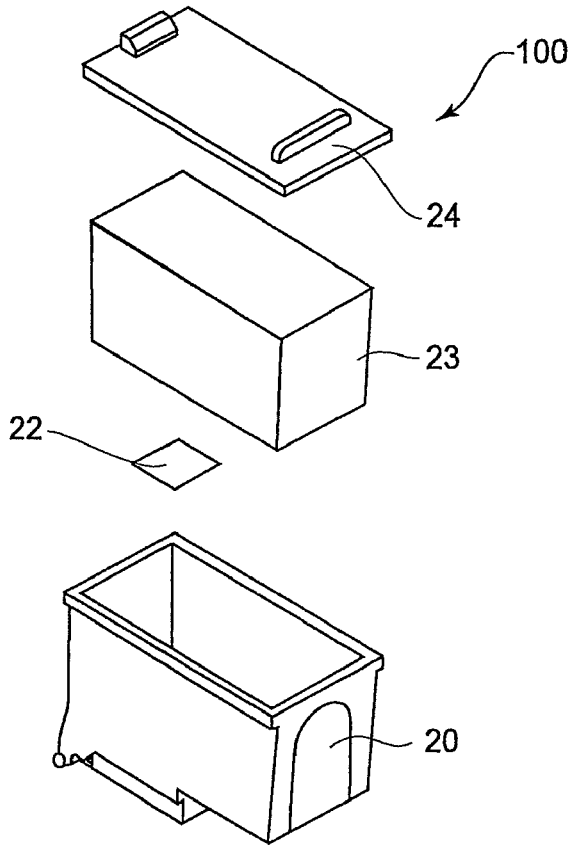

Next, an example of an ink jet recording head in accordance with the present invention will be described in detail with reference to the appended drawings. FIGS. 1A and 1B are external perspective views of the ink jet recording cartridge (which hereafter will be referred to as recording head 100), and show the general structure of the ink jet recording cartridge. FIGS. 2A and 2B are exploded perspective views of the ink jet recording cartridge shown in FIGS. 1A and B.

The recording head 100 in this embodiment is an integral combination of several structural components. It is removably mountable on the carriage of the main assembly of an unshown ink jet recording apparatus. As it is mounted on the carriage, it is firmly held to the carriage, by the positioning means and electrical contacts of the carriage so that it is precisely positioned relative to the carriage. It is to be replaced with another recording head (100) as the ink therein is completely consumed. Incidentally, not only is the present invention applicable to the recording head 100 in this embodiment, that is, a recording head integral with an ink container, but also, a recording head which is physically independent from an ink container so that as the ink container with which it is fitted becomes empty, the ink container alone can be replaced.

Hereafter, the recording head 100 will be described in detail.

The recording head 100 in this embodiment is an ink jet recording head which employs electrothermal transducers as the means for generating the thermal energy for boiling ink in response to electrical signals. As shown in FIGS. 2A and 2B, which are exploded perspective views of the recording head 100, the recording head 100 in this embodiment is made up of an ink jet head chip 1, an electrical wiring tape 10, a housing 20, a filter 22, an absorbent member 23 which absorbs and retains ink, and a lid 24.

The electrical wiring tape 10 is a flexible member which has electrical wiring. It provides passages through which the electrical signals, for making the ink jet head chip 1 jet ink, are applied to the ink jet head chip 1. The electrical wiring tape 10 is provided with an opening 11 (hole), in which the ink jet head chip 1 is fitted. The electrical wiring tape 10 is also provided with leads 12 (first wires), which extend from the edges of the opening 11, and are connected to the pads 2 (electrical contacts) (FIG. 4A) of the ink jet head chip 1. Further, the electrical wiring tape 10 is provided with signal input terminals 13 through which external signals, that is, the electrical signals from the main assembly of the ink jet recording apparatus, are received. The first leads 12 are in connection to the external signal input terminals 13 through a patterned wiring (unshown) made up of thin foil of copper.

The electrical wiring tape 10 structured as described above is laid along the external surface of the housing 20. More concretely, it is bent at a preset point in terms of its lengthwise direction, and one side of the electrical wiring tape 10 relative to the line of bend is provided with the aforementioned external electrical signal input terminals 13. The electrical wiring tape 10 is solidly attached to one of the lateral walls of the housing 20 by the abovementioned portion having the external electrical signal input terminals 13, whereas the other portion, that is, the portion having the opening 11, is solidly attached to the bottom surface (which faces recording medium during recording) of the housing 20. Further, the ink jet head chip 1 is in the opening 11 of the electrical wiring tape 10.

The electrical connection between the electrical wiring tape 10 and ink jet head chip 1 is made using one of the following methods: For example, a bump, with which each of the pads 2 (electrical contacts) of the ink jet head chip 1 is provided, may be joined with the corresponding first lead 12 of the electrical wiring tape 10 by ultrasonic welding. Further, in order to increase production efficiency, it is possible to use gang bonding to make electrical connection between the electrical wiring tape 10 and ink jet head chip 1. In this case, the pads 2 of the ink jet head chip 1 are plated, and the multiple leads 12 (first wires) of the electrical wiring tape 10 are joined all at once with the corresponding pads 2 of the ink jet head chip 1.

Figure 3A:
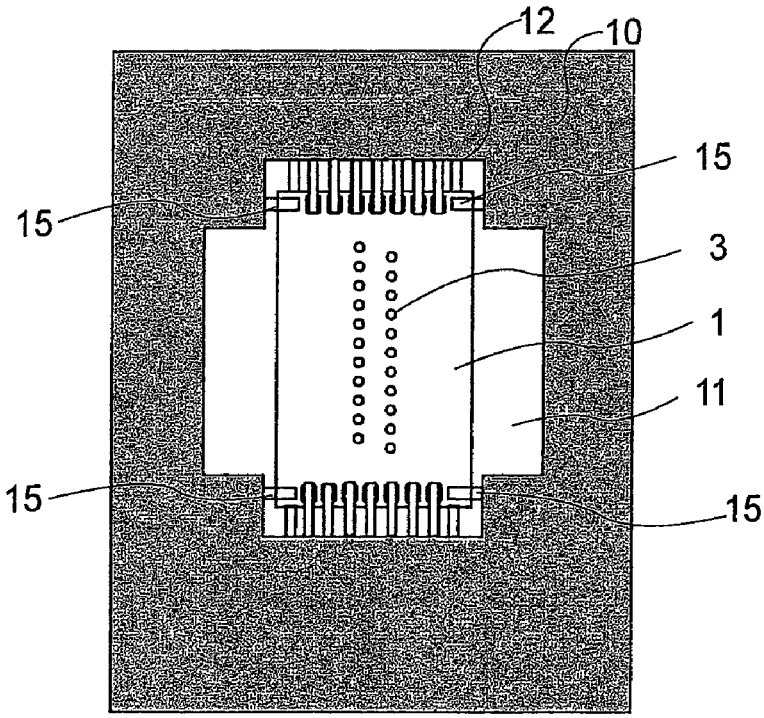
FIGS. 3A and 3B are bottom plan views of the recording head chip of the ink jet recording cartridge shown in FIGS. 1A and 1B, and its adjacencies, FIGS. 3A and 3B showing the ink jet head chip and its adjacencies prior to, and after, the application of the sealant, respectively.
Figure 3B:
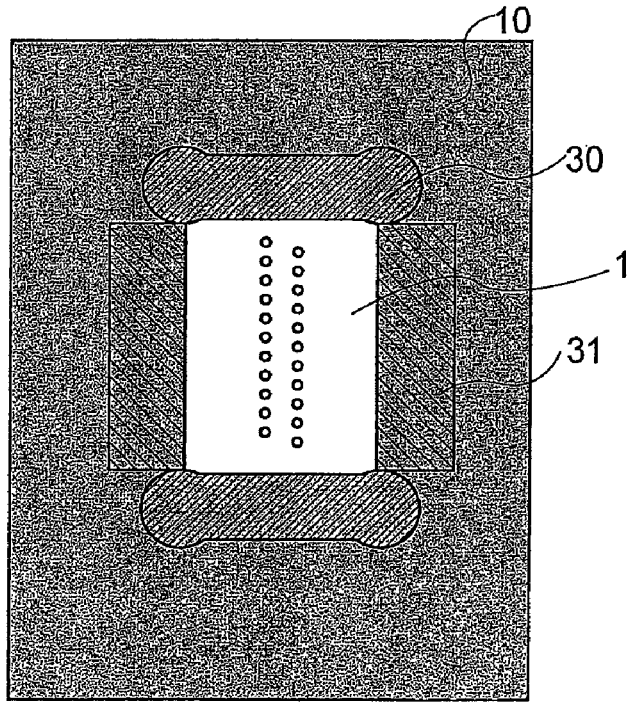
Figure 4A:
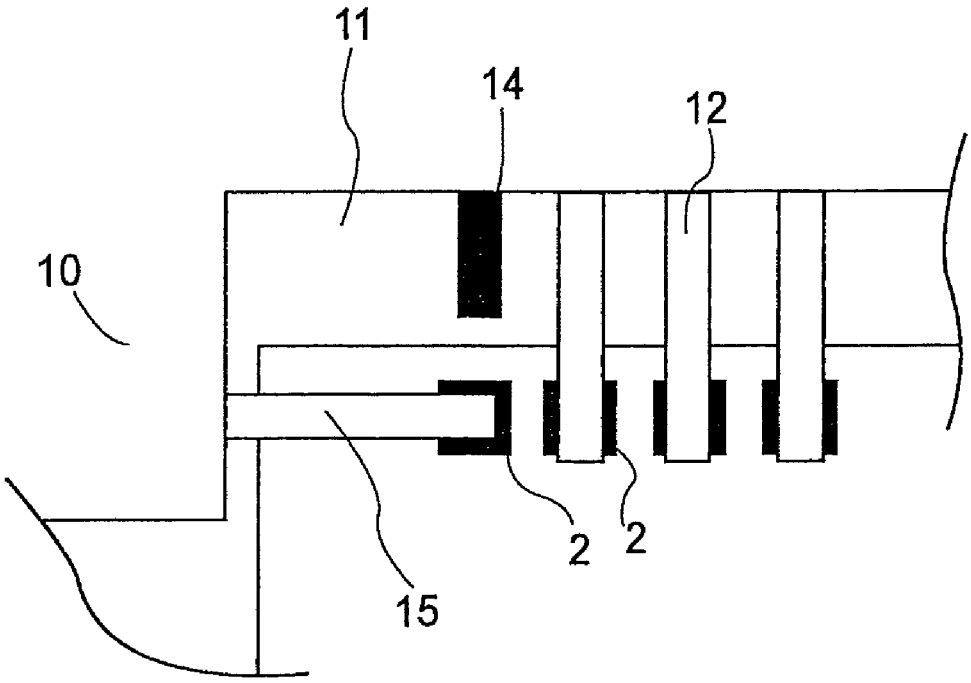
FIG. 4A is an enlarged view of a part of FIG. 3A.
Figure 4B:
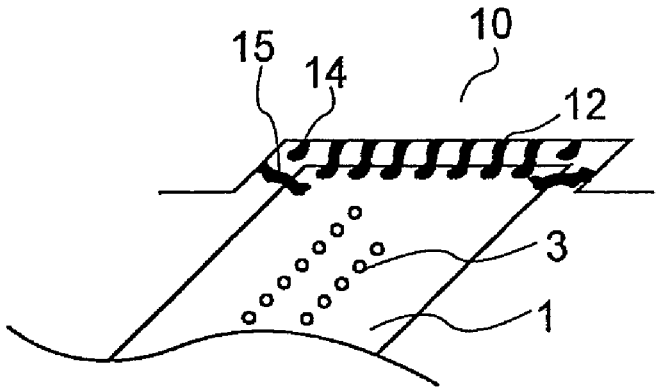
FIG. 4B is a perspective view of a part of the ink jet head chip shown in FIG. 4A, and its adjacencies.

Next, referring to FIGS. 3A to 4B, the structural features of the adjacencies of the ink jet head chip 1, which are related to the sealing of the electrical junctions between the ink jet head chip 1 and electrical wiring tape 10, will be described. FIGS. 3A and 3B are bottom plan views of the ink jet head chip 1, and its adjacencies, of the recording head 100, prior to, and after, the application of the sealant (thermally curable resin, for example), respectively. FIG. 4A is an enlarged view of a part of FIG. 3A, and FIG. 4B is a perspective view of a part of the portion of the recording head 100 shown in FIG. 4A.

Referring to FIG. 3A, the first leads 12 extend, in parallel with preset intervals, from the opposing two edges of the opening 11 of the electrical wiring tape 10, in the direction parallel to the lengthwise direction of the electrical wiring tape 10. The electrical wiring tape 10 is also provided with second leads 15, each of which extends from the other opposing two edges of the openings 11. More specifically, the second leads 15 are members for catching and supporting sealant, and extend in the direction perpendicular to that in which the first leads 12 extend.

Referring to FIG. 4A, the first and second leads 12 and 15 are similar to each other in that they both extend inward of the opening 11 from one of the edges of the opening 11. In this embodiment, the first and second leads 12 and 15 are the same in shape and measurement. Obviously, it is not mandatory for the applicability of the present invention that the first and second leads 12 and 15 are similar in shape and measurement. Incidentally, the edge of the opening 11, from which the first leads 12 extend, and the edge of the opening 11, from which the second leads 15 extend, are perpendicular to each other. Therefore, the direction in which the first leads 12 extend is intersectional, or perpendicular, to the direction in which second leads 15 extend. Each of the second leads 15 extends in the direction parallel to the direction (which is parallel to edge of opening 11, from which first leads 12 extend) in which the first sealant 30 is applied to cover the electrical joints between the leads 12 and pads 2. Further, each second lead 15 is in contact with the surface of the ink jet head chip 1.

Further, the second leads 15 are in connection to the external signal input terminals 13 (FIG. 1A) also through an unshown patterned wiring, and are in contact with the preset pads 2 of the ink jet head chip 1, as are the first leads 12. The method used for joining the second leads 15 with the pads 2 is the same as the method used for joining the first leads 12 with the pads 2.

As described above, the surface of the electrical wiring tape 10 is positioned higher than the surface (which has pads 2) of the ink jet head chip 1. Here, "positioned higher" means "greater in distance from the housing 20". For example, it is evident from FIG. 4B that the surface of the electrical wiring tape 10 is higher in position than the surface of the ink jet head chip 1.

The second lead 15 provides a slanted surface which gently slopes downward from the surface of the electrical wiring tape 10, which is higher in position than the surface of ink jet head chip 1, to the surface of the ink jet head chip 1 (FIG. 4B). Therefore, the body of first sealant 30 does not narrow (it remains uniform in width) after the application of the first sealant 30 (FIG. 3B); in other words, it is possible to reliably apply the first sealant 30. The second lead 15 is in contact with the corresponding pad 2 of the ink jet head chip 1, as is the first lead 12. Therefore, it may be utilized as the lead for applying an electrical signal to the ink jet head chip 1, or may be left as a dummy signal wire, that is, a lead through which an electrical signal is not transmitted.

As described above, the second lead 15, which is for catching and supporting the first sealant 30, and is located next to the end of the set of first leads 12, is connected to the ink jet head chip 1. Thus, a slanted surface which gently slopes down from the electrical wiring tape 10 to the ink jet head chip 1 is provided. Therefore, as far as the application of the sealant 30 is concerned, the step which is present between the surface of the electrical wiring tape 15 and the surface of the ink jet head chip 1 is eliminated, preventing thereby the problem that the needle for applying the first sealant 30 has to be abruptly changed in the direction while it is used for applying the first sealant 30. Therefore, it is possible to prevent the problem that the body of first sealant 30 partially narrows after the application of the first sealant 30.

Obviously, even if the second lead 15 is not in connection with the pad 2 of the ink jet head chip 1, the above described effect is achievable, because the above described slanted surface can be provided as long as the second lead 15 is placed in contact with the surface of the ink jet head chip 1 (preferably, portion of surface of ink jet head chip 1, which has pads 2, or adjacencies thereof). Here, "contact" is a concept which includes "connection". Further, the second lead 15 does not need to be a lead; it may be simply a member forming an inclined surface although it is a long and narrow rectangle member in this example.

Incidentally, as will be evident from FIG. 3A, in this embodiment, the distance between the long edge of the ink jet head chip 1 and the opposing edge of the opening 11 of the electrical wiring tape 10 is not uniform. More concretely, the distance between the ink jet head chip 1 and electrical wiring tape 10 is smaller in the area corresponding to the lengthwise end portions of the ink jet head chip 1 than the area corresponding to the lengthwise center portion of the ink jet head chip 1. This structural feature can minimize the effects of the contraction of the body of first sealant 30, which occurs when the second sealant 31 hardens. Obviously, in this embodiment, the gentle slope is provided between the electrical wiring tape 10 and ink jet head chip 1 by the second lead 15. Therefore, even if the opening 11 of the electrical wiring tape 10 is not shaped so that the distance between the end portion of each long edge of the ink jet head chip 1 and the corresponding edge of the opening 11, which is parallel to the long edge of the ink jet head chip 1, is smaller than the distance between the rest of each long edge of the ink jet head chip 1 and the corresponding edge of the opening 11, which is parallel to the long edge of the ink jet head chip 1, it is possible to properly apply the first sealant 30, and therefore, it is possible to prevent the body of first sealant 30 from being cracked by the contraction of the body of second sealant 31, which occurs as the second sealant 31 hardens.

Designated by a referential number 14 in the drawing is a dummy lead, which is located a preset distance from the end of the set of first leads 12. The dummy lead 14 extends in the same direction as the first leads 12. The presence of a dummy lead, such as the dummy lead 14, enhances the effect of the provision of the second lead 15, that is, the effect of preventing the problem that the needle for applying the first sealant 30 has to be abruptly changed in the direction while it is used for applying the first sealant 30. Therefore, it is possible to more effectively prevent the problem that the body of first sealant 30 partially narrows after the application of the first sealant 30. Thus, it is possible to apply the first sealant 30 with a higher level of accuracy. It is obvious, however, that the dummy lead 14 is not a structural element which is mandatory for the embodiment of the present invention.

Further, as described above, the second lead 15 may be a member enabled to function as an actual electrical lead, or it may be a member incapable of functioning as an electrical lead. Further it may be an integral part of the electrical wiring tape 10, which is free of the leads 12. That is, as long as the second lead 15 is a member capable of achieving the object of the present invention, it does not matter whether it is an actual electrical lead or not, or whether it is capable of transmitting electrical signals. It is an elongated member.

Embodiment 2

Figure 5A:
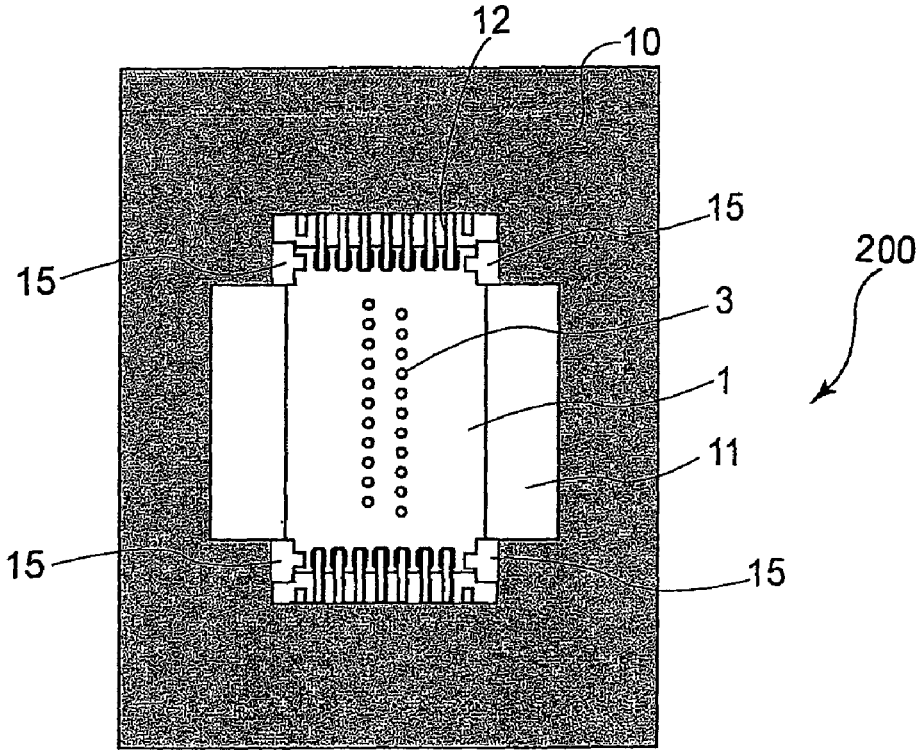
FIGS. 5A and 5B are bottom plan views of the recording head chip of the ink jet recording cartridge, and its adjacencies, in another preferred embodiment of the present invention, FIGS. 5A and 5B showing the ink jet head chip and its adjacencies prior to, and after, the application of the sealant, respectively.
Figure 5B:
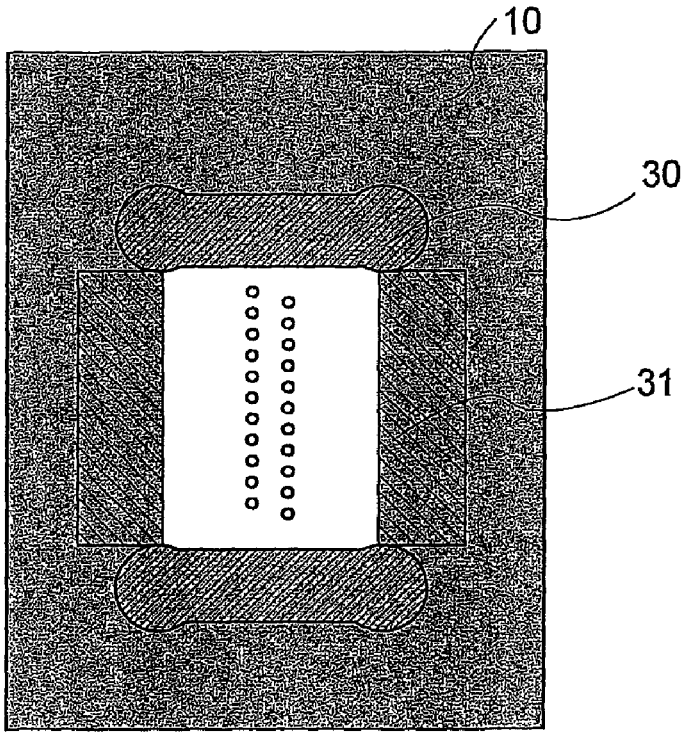
Figure 6A:
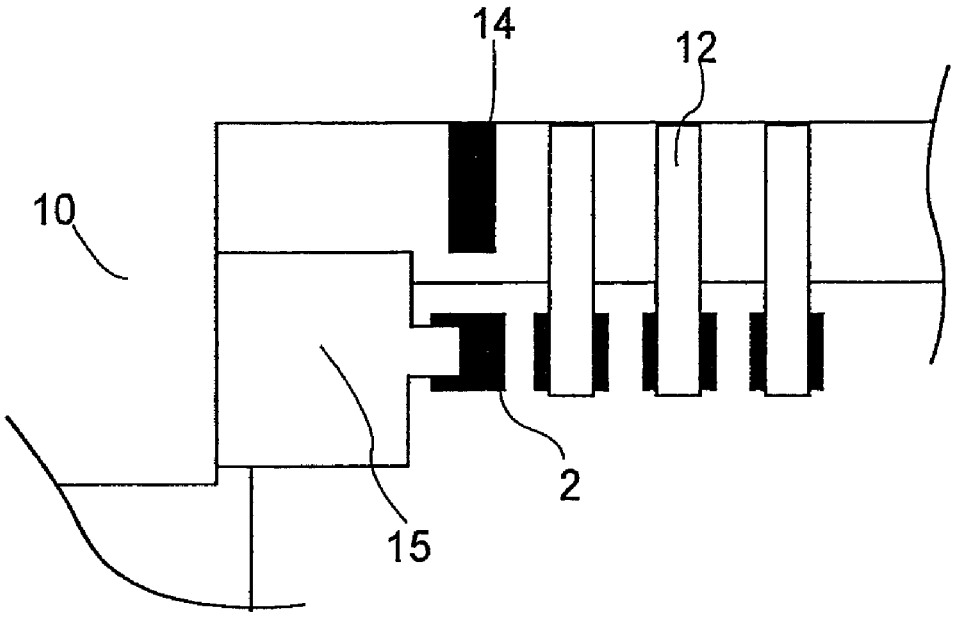
FIG. 6A is an enlarged view of a part of FIG. 5A.

Next, the ink jet recording head in another preferred embodiment of the present invention will be described in detail with reference the appended drawings. FIGS. 5A and 5B are bottom plan views of the ink jet head chip 1, and its adjacencies, of the ink jet recording cartridge (which hereafter will be referred to as recording head 200), in another preferred embodiment of the present invention, FIGS. 5A and 5B showing the ink jet head chip 1 and its adjacencies prior to, and after, the application of the sealant, respectively. FIG. 6A is an enlarged view of a part of FIG. 5A, and FIG. 6B is a perspective view of a part of the ink jet head chip 1, and its adjacencies, shown in FIGS. 5A and 5B.

The recording head 200 in this embodiment is the same in basic structure as the recording head 100 in the first embodiment, and therefore, the portions of the recording head 200, which are the same as those of the recording head 100, will not be described.

Referring to FIG. 5A, in the case of the recording head 200 in this embodiment, the second lead 15, which is for catching and supporting the first sealant 30, is wider than the first lead 12. More concretely, referring to FIG. 6A, in terms of the direction parallel to the lengthwise direction of the recording head 200, the portion of the second lead 15, which is not placed in contact with the first pad 2 of the ink jet head chip 1, is wider than the portion of the second lead 15, which is placed in contact with the first pad 2. Further, the portion of the second lead 15, which is not placed in contact with the first pad 2, is wider than the width of the first lead 12.

Figure 6B:
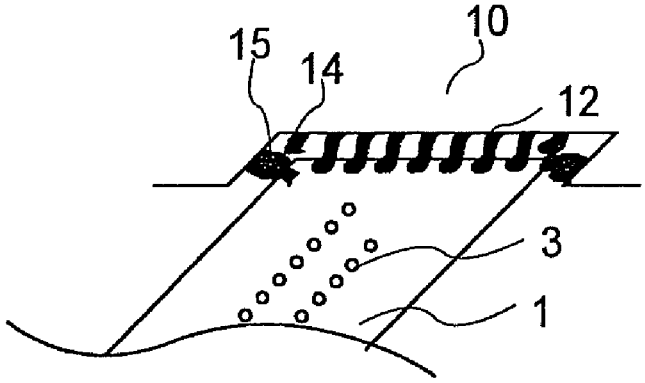
FIG. 6B is a perspective view of a part of the ink jet head chip and its adjacencies, shown in FIG. 6A.
Figure 7A:
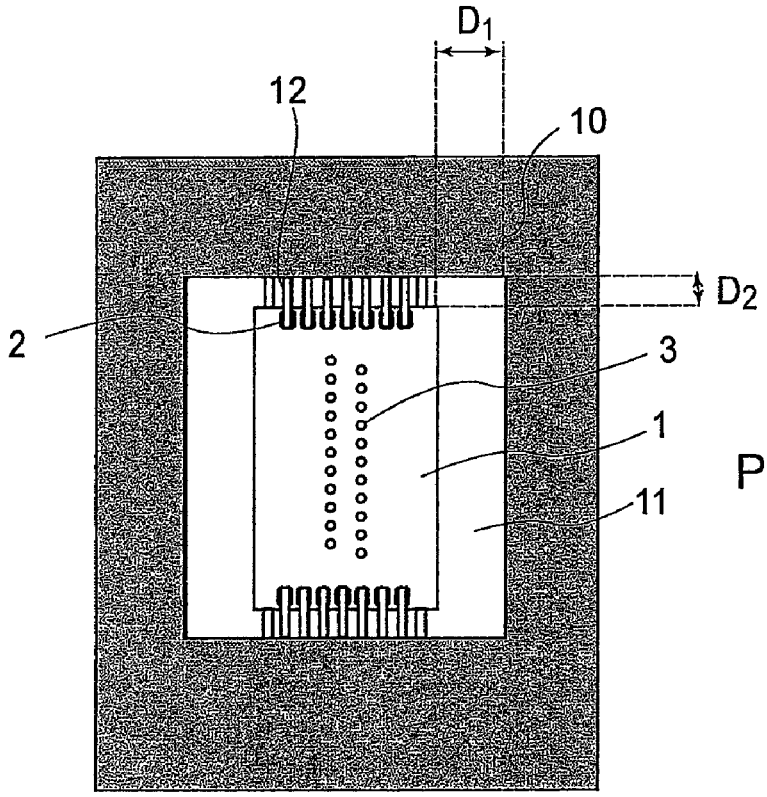
PRIOR ART FIG. 7A
FIG. 7A and 7B are bottom plan views of the ink jet head chip of an ink jet recording cartridge in accordance with the prior art, and its adjacencies, FIGS. 7A and 7B showing the ink jet head chip and its adjacencies prior to, and after, the application of the sealant, respectively.
Figure 7B:
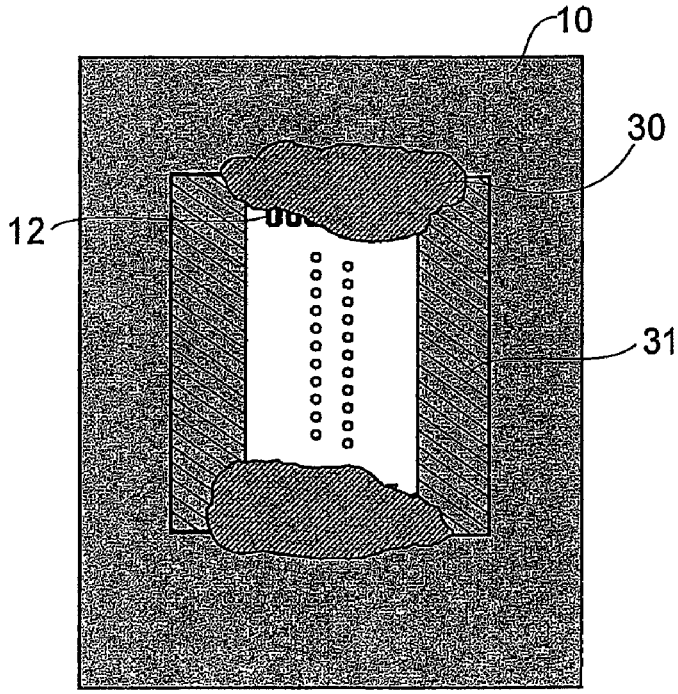
PRIOR ART FIG. 7B
Figure 8A:
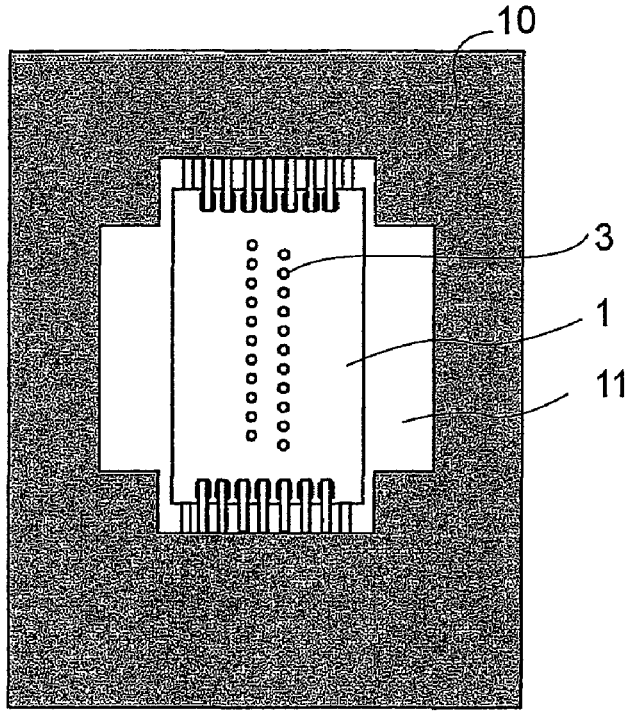
PRIOR ART FIG. 8A
FIGS. 8A and 8B are bottom plan views of the ink jet head chip of an example of another ink jet recording cartridge in accordance with the prior art, and its adjacencies, FIGS. 8A and 8B showing the ink jet head chip and its adjacencies prior to, and after, the application of the sealant, respectively.
Figure 8B:
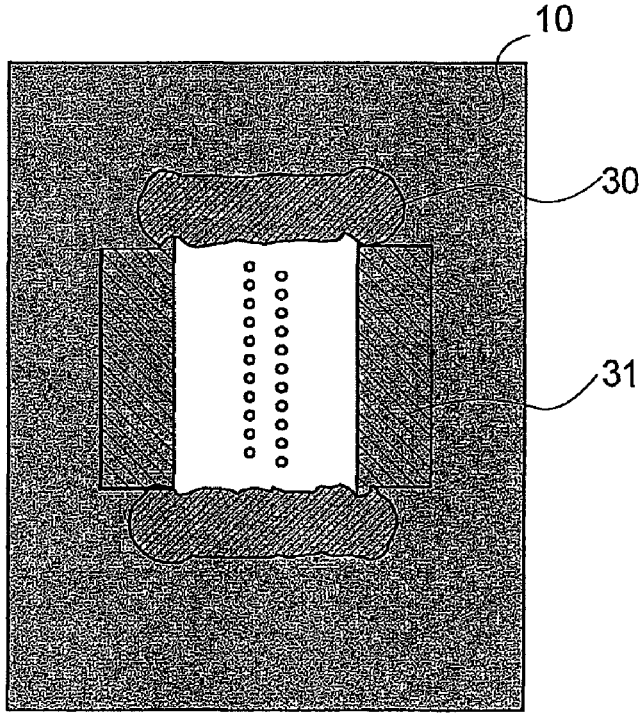
PRIOR ART FIG. 8B
Figure 9:
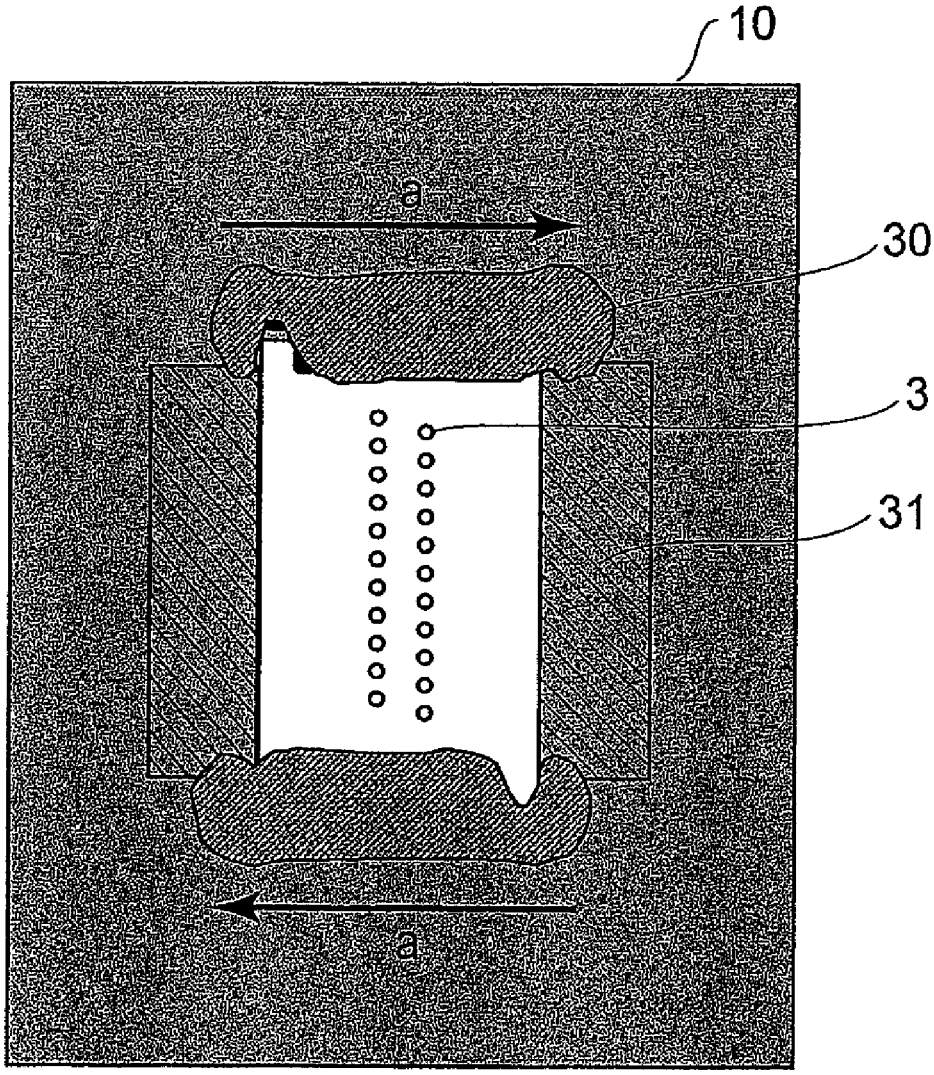
FIG.9 PRIOR ART
FIG. 9 is a bottom plan view of the ink jet recording cartridge in accordance with the prior art, showing the narrowing which occurred to the body of first sealant.

Referring to FIG. 6B, with the provision of the structural arrangement described above, a slanted surface, which gently slopes from the surface of the electrical wiring tape 10 to the surface of the ink jet head chip 1, is provided by the second lead 15, that is, the lead for catching and supporting the first sealant 30. Therefore, the first sealant 30 can be applied reliably, that is, while preventing the body of first sealant 30 from partially narrowing while the first sealant 30 is applied.

Further, in the case of the recording head 200 in this embodiment, the portion of the second lead 15, which is not placed in contact with the pad 2 of the ink jet head chip 1, is wider than the portion of the second lead 15, which is placed in contact with the pad 2 of the ink jet head chip 1. Therefore, it is ensured that the first sealant 30 is caught and supported by the second lead 15. Therefore, even if the sealant 30 is applied at a higher speed for tact reduction, it is ensured that the sealant 30 properly settles (body of sealant 30 does not partially narrow). Further, the second lead 15 is placed in contact with the pad 2 of the ink jet head chip 1, or the adjacencies of the pad 2, as is the first lead 12 of the electrical wiring tape 10. Therefore, the second lead 15 can be used as an actual electrical lead for applying electrical signals to the ink jet head chip 1. The concept of "being placed in contact" includes the concept of "being connected".

As described above, in this embodiment, the second lead 15, which is for catching and supporting the sealant 30, is positioned next to each end of the set of the first leads 12, and is placed in contact with the ink jet head chip 1. Therefore, a slanted surface, which gently slopes from the surface of the electrical wiring tape 10 to the surface of the ink jet head chip 1, is provided. In addition, the second lead 15 in the second embodiment is wider than the second lead 15 in the first embodiment. Therefore, it can provide a sealant supporting surface, which is greater in size than the sealant supporting surface provided by the second lead 15 in the first embodiment. Therefore, it can eliminate the step between the surface of the electrical wiring tape 10 and the surface of the ink jet head chip 1, across the wider area. Therefore, even if the speed at which the sealant 30 is applied is increased for tact reduction, the first sealant 30 can be applied reliably, that is, without causing the body of first sealant to partially narrow.

Further, as described above, the second lead 15 may be formed as an actual electrical lead, that is, a member having an electrical connection, or may be formed as a dummy lead. Further, it may be formed as an integral part of the substrate of the electrical wiring tape 10, which is in the form of a long and narrow rectangle. That is, as long as the second lead 15 in this embodiment is in the form of an elongated member, it does not matter whether or not it has electrical wiring, or whether or not it is capable of conducting electricity.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Application Nos. 338199/2006 and 283519/2007 filed Dec. 15, 2006, and Oct. 31, 2007, respectively, which are hereby incorporated by reference herein.

What is claimed is:

1. An ink jet recording head comprising:

a recording element substrate having energy generating means for generating energy in accordance with an electric signal, and a plurality of electrode portions for receiving the electric signal to be supplied to said energy generating means, wherein the electrode portions are arranged along one end of said recording element substrate; and an electric line member including an opening in which said recording element substrate is contained, an electric line extending toward an inside of the opening and connected to said electrode portions, an inclined electric wiring extending in a direction crossing with said electric line and contacted to an end electrode portion of said electrode portions, wherein said electric line member is disposed above a surface, having said electrode portions, of said recording element substrate, wherein the inclined electric wiring extends in a direction of an arrangement of a plurality of electric lines, and forms an inclined surface descending from said electric line toward the surface of said recording element substrate.

2. An ink jet recording head according to claim 1, further comprising a connecting portion between said electric line and said electrode portions, wherein the connecting portion is covered and sealed by a first sealing material, and a portion of a region adjacent to said recording element substrate except for the connecting portion is sealed by a second sealing material.

3. An ink jet recording head according to claim 2, wherein said inclined electric wiring is covered and sealed by the first sealing material.

4. An ink jet recording head according to claim 1, wherein said inclined electric wiring is connected to said electrode portions.

5. An ink jet recording head according to claim 1, wherein said inclined electric wiring is a dummy line not conducting the electric signal.

6. An ink jet recording head according to claim 1, wherein said inclined electric wiring has a reduced width at the connecting portion for connection with said recording element substrate.

7. An ink jet recording head according to claim 6, wherein said inclined electric wiring has, in a portion except for the connecting portion, a width which is larger than said electric line.

* * * * *